United States Patent [19]

Marzoli

[11] 4,138,778

[45] Feb. 13, 1979

[54] METHOD AND APPARATUS FOR MOUNTING AND DISMANTLING THE RESILIENT LININGS OF PRESSURE ROLLERS EMPLOYED IN THE DRAWING-SYSTEMS OF MACHINES PREPARATORY TO SPINNING

[75] Inventor: Angelo Marzoli, Palazzolo S. Oglio (Brescia), Italy

[73] Assignee: F. lli Marzoli & C. S.p.A., Palazzolo S. Oglio (Brescia), Italy

[21] Appl. No.: 855,529

[22] Filed: Nov. 28, 1977

[30] Foreign Application Priority Data

Dec. 28, 1976 [IT] Italy ..... 30911 A/76

[51] Int. Cl.[2] ..... B23P 19/02

[52] U.S. Cl. ..... 29/235; 29/148.4 D

[58] Field of Search ..... 29/235, 516, 517, 820, 29/234, 252, 427, 450, 148.4 D

[56] References Cited

U.S. PATENT DOCUMENTS

| | | | |
|---|---|---|---|
| 2,498,357 | 2/1950 | Breisch | 29/235 X |
| 2,604,658 | 7/1952 | Broden | 29/235 X |
| 3,449,811 | 6/1969 | DeLigt | 29/235 |

*Primary Examiner*—Milton S. Mehr

*Attorney, Agent, or Firm*—Karl W. Flocks

[57] ABSTRACT

For mounting and dismantling a resilient liner of a pressing roller of a draft-frame in textile machinery preparatory to spinning, a method is suggested which comprises the steps of positioning the liner on a temporary supporting member, inserting the roller into the liner with a snug fit while simultaneously slipping the temporary supporting member away. The worn out liner can be removed by cutting it longitudinally on at least two parallel lines by means of radially projecting blades mounted on a specially provided collar, the cut liner being then manually peeled off. An apparatus for performing these operations quickly and conveniently is also described. The method and apparatus in question permit to dispense with adhesives for fastening the resilient sleeve to its own supporting member, and affords the possibility of removing the resilient layer without damaging the roller in any wise.

3 Claims, 5 Drawing Figures

METHOD AND APPARATUS FOR MOUNTING AND DISMANTLING THE RESILIENT LININGS OF PRESSURE ROLLERS EMPLOYED IN THE DRAWING-SYSTEMS OF MACHINES PREPARATORY TO SPINNING

This invention relates to a method and an apparatus for mounting and dismantling the resilient liners of pressure rollers employed in the drafting systems of machines preparatory to sprinning.

It is known that the pressure rollers as employed in the draw frames of machines preparatory to spinning are equipped with an elastomeric liner, which, according to the conventional art, was slipped onto the corresponding roller and fastened thereto by direct cementing. On account of the high speeds at which the present machines preparatory to spinning are driven, its obvious that the liners of the pressure rollers undergo both high temperatures and considerable stresses, so that, if their cementing has not been carried out in a workmanlike manner, they become loosened after but a few hours of operation of the rollers and can even burst due to possible sliver wrap on localized spots.

Another kind of liner which overcomes such a drawback is composed by an elastomeric material which is cured on a tubular metallic supporting member.

Such elastomeric liners with a tubular metallic supporting member are commercially known under the name of "press-fit" and are mounted on the rollers and cemented thereon by means of a special adhesive which ensures an optimum adhesion after a 6-hour stay at room temperature. The liner can thereafter be machined and the roller used on the machine concerned.

When the liner is virtually used up, after a number of machining passes, it is necessary to strip it from the roller and this operation can be made in two ways: either the roller is heated with the liner to be stripped to a temperature of about 200° C. so that the adhesive loses its properties and the liner can be slipped out of the roller, or a turning operation is performed to remove the liner residues. Both these procedures involve considerable shortcomings. Often it is not possible to heat the roller to 200° C. without incurring the hazard of damaging members connected to or incorporated in the rollers, such as bearings and the like. Turning must be carried out very charily so as not to damage the roller surface, and requires specialized attendants and much time.

An object of the present invention is to provide both a method and an apparatus for reducing the method to practice, which facilitate a reliable mount of the elastomeric liner on a tubular metallic supporting member over a metal roller, as well as the dismantling of the liner without any hazard of spoiling the roller surface.

In order that such an object may be achieved, the invention provides a method which, for mounting the liner on the rôller, suggests the positioning of the liner on an axially slippable temporary supporting member, the head-on insertion of the roller onto the liner with a snug fit and the simultaneous slipping of the temporary supporting member from the opposite end of the liner, whereas the dismantling of the liner provides a longitudinal slitting thereof, preferably along at least two opposite generating lines up to a distance from the periphery of the roller of from 0.05 to 0.25 millimeters, preferably 0.1 millimeters and the subsequent stripping of the two liner halves.

The apparatus for reducing such a method into actual practice comprises a framing in which there are coaxially mounted and spaced apart from one another a tubular member with longitudinal slits which are terminated at either end of such member, and a piston and cylinder assembly the piston of which is adapted to be shifted towards said end of the tubular member where such slits are terminated, a first guiding bushing mounted coaxially with the other end of said tubular member, a second guiding bushing having an annular flange in the vicinity of either of its ends, said second bushing being insertable, optionally, with either of its ends coaxially into the end of the tubular member confronting said piston and cylinder assembly, the difference between the inside diameter of the tubular member and the inside diameter of such guiding bushings being slightly greater than twice the thickness of the liner to be mounted or overhauled, whereas the inside diameters of the guiding bushings is substantially equal to the outside diameter of the roller on which the liner is to be mounted or from which it must be removed, a collar carrying internally a set or radial blades, the distance between the cutting edges of such blades being slightly greater than the outside diameter of said roller, said collar being slidably insertable on said tubular member with the blades passing through the longitudinal slits of such member and being drivable by said piston with the intermediary of a spreader for sliding along the tubular member from the end thereof at which the slits are terminated onto the opposite end of said member.

To use such implementation for mounting a liner onto a roller, the liner is inserted in the tubular member between said guiding bushings with a temporary supporting member slipped with a certain clearance onto the interior of the liner, whereafter the roller is slipped into the second bushing and on the free end of the roller the piston of the piston and cylinder assembly is caused to act: by causing then the piston to emerge from the cylinder by the agency of a fluid under pressure fed to the cylinder, the roller is thrust axially to enter the liner snugly, the provisional supporting member inserted in the liner being concurrently ejected from the opposite end, until the liner becomes slipped onto the roller and snugly fitted thereon.

In order that the desired match between the liner and the roller might be achieved, it is required that the inside diameter of the metallic tubular supporting member for the liner is smaller than, or, at the most, equal to, the outside diameter of the roller, the difference between the two diameters being compulsorily comprised between the limits of from 0 to 0.3 millimeters.

When, conversely, the apparatus is used for dismantling the liner from a roller, the latter is placed in the interior of the tubular member with its ends inserted in the two bushings, respectively. To the tubular member there has been applied the collar with the blades passed through the slits of the tubular member and, by means of the piston, by means of the spreader, the blade carrying collar is displaced and the blades, during such a shift, cut the liner along generating lines which are preferably diametrically opposite to one another. The cut takes place down to a very short distance from the roller surface, so that, on completion of the cutting and after having removed the roller from the implementation, the liner can conveniently be stripped since it is no longer cemented to the roller.

The method and the implementation according to this invention thus make possible not only the quick and reliable mounting of the elastomer coating with a supporting tubular member by merely fitting the former snugly onto the latter, but they also permit that the roller liner may be removed in a extremely quick and simple manner from its roller without any risk of damaging the roller surface as such.

The method according to the invention will now be described in more detail with reference to the accompanying drawings which diagrammatically show an exemplary embodiment of an apparatus for carrying out the method in question and, precisely:

Figure 1:
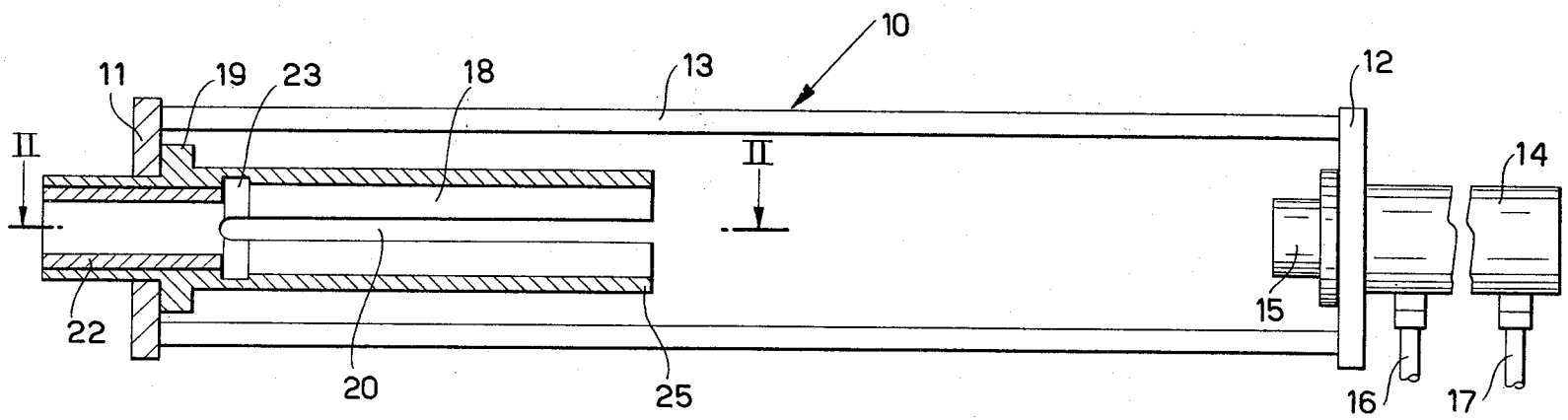
FIG. 1 is an elevational view, partly in axial vertical cross-section, of the apparatus ready to be used either for mounting a liner onto a roller, or for dismountling the liner from its roller.

As can be seen on FIG. 1, the installation generally comprises a casing, indicated at 10 and consisting of two plates 11, 12 which are assembled together in parallel relationship by two struts 13.

Centrally of the plate 12 is mounted a cylinder 14, the piston 15 of which emerges through an end of the cylinder and is passed through an opening formed through the plate 12. The cylinder 14 can be single- or double-acting and can be actuated by any fluid under pressure coming from an appropriate source and properly controlled.

Conduits 16 and 17 are shown which can alternately be connected to the pressure source and to the discharge end so as to have the piston 15 emerging from, or entering into the cylinder 14.

In a bore formed through the plate 11, coaxially with the cylinder 14, a tubular member 18 is mounted, which rests by the intermediary of an outer midway flange 19 against the plate 11 and is fastened thereto by any conventional means, not shown.

The portion of the member 18 which is inside the casing 10 has two longitudinal slits 20, 21 which are terminated at the end 25 of member 18 which is facing the piston 15.

Figure 2:
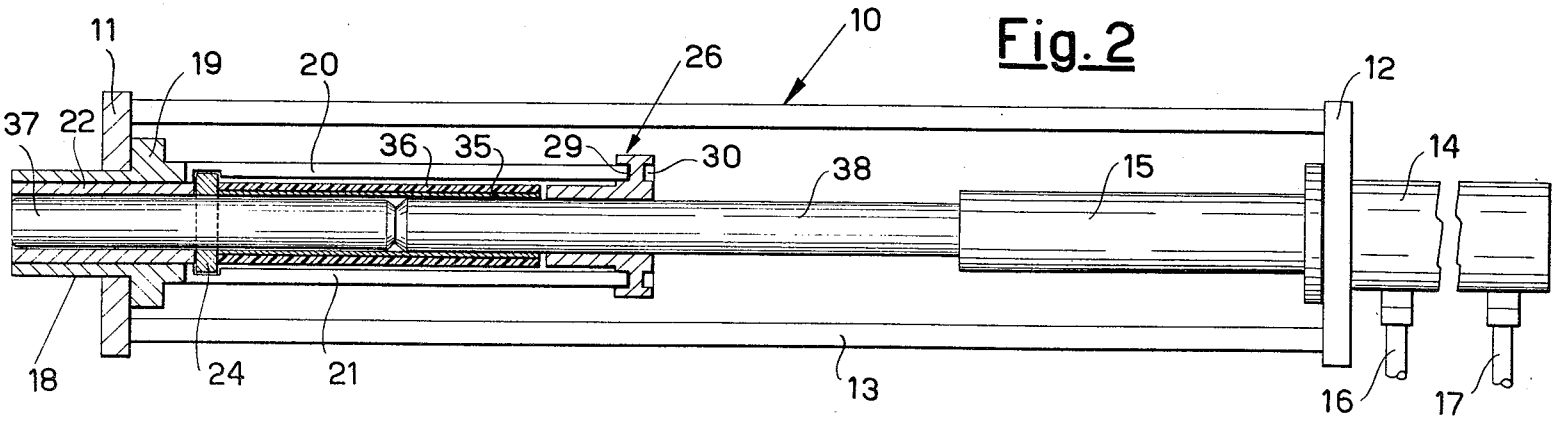
FIGS. 2 and 3 are plan views, partly in horizontal cross-section taken along the line II—II of FIG. 1, of the apparatus while it is being used for mounting and dismantling, respectively, a roller liner.

In the other end of the element 18 there is slipped with a snug fit a bushing 22 of a synthetic material, preferably of the self-lubricating type. Where the bushing 22 is internally terminated, the member 18 has an annular groove 23 which is intended to receive an abutment ring 24 (best seen in FIG. 2).

Figure 5:
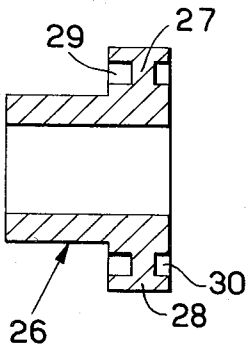
FIGS. 4 and 5 show an axial cross-sectional view of two details of the machine.

Through the end 25 of the member 18, in correspondence with which the slits 20, 21 are terminated, a bushing 26 can be slipped (see FIGS. 2 and 3), such bushing being illustrated in detail in FIG. 5.

This bushing has, in the vicinity of either of its ends, a flange 27 which forms, peripherally, a cylindrical sliding surface 28. In addition, in such flange there are formed two confrontingly arranged annular grooves 29 and 30.

Figure 3:
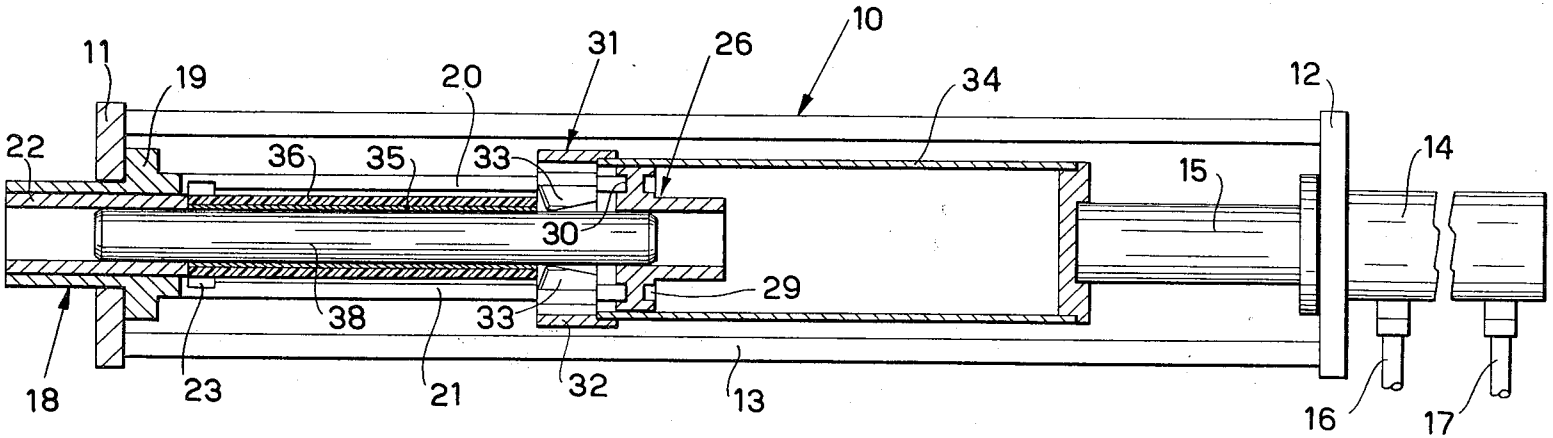

When using the apparatus in question for mounting a liner on a roller (FIG. 2) the bushing 26 is mounted on the end 25 of the tubular member 18 with such end 25 inserted in the groove 29, whereas, when the apparatus is used for dismantling the liner from a roller, the end 25 of member 18 is inserted in the groove 30 of the bushing 26 (FIG. 3).

Figure 4:
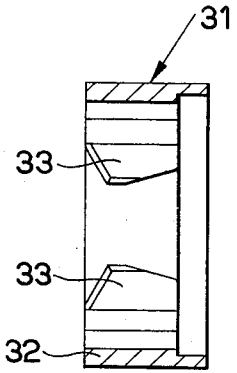

Lastly, the apparatus comprises, for use in dismantling a liner, a collar carrying two blades, indicated generally at 31 and shown in detail in FIG. 4. It is a simple ring 32 which carries, internally and on diametrically opposite positions, two blades 33 placed radially with the cutting edges substantially parallel to the axis of ring 32. The distance between the cutting edges of the two blades 33 is slightly greater than the outside diameter of a roller from which the liner is to be removed: in practice, the distance between the cutting edges of the two blades exceeds the outside diameter of the roller by 0.1–0.5 millimeters, preferably by 0.2 millimeters.

Inasmuch as the tubular metallic supporting member of the elastomeric liner material has a thickness of about 3–4 millimeters, on completion of the cutting with the two blades in correspondence with each cutting line, a thickness of about 0.1 millimeters is left for the metallic supporting member, so that the removal can be effected very conveniently.

As can be seen in FIG. 3, the collar 31 is slipped onto the tubular member 18 prior to applying the bushing 26 (turned upside down relative to the position of FIG. 2) and thus, between the piston 15 and the collar 31, a spreader 34 is inserted, having somewhat the form of a cup, on the botom of which the end of the piston 15 is active and which can slide by virtue of its internal tubular wall on the peripheral surface 28 of the flange 27 of the bushing 26.

When using the apparatus for mounting a liner onto a roller, the procedure is as follows.

The apparatus is prepared with the ring 24 inserted in the groove 23 of the tubular member 18 (see FIG. 2), whereas the cutter-carrying collar 31 and the spreader 34 can be dispensed with. The complete liner to be mounted, composed by a metallic tubular supporting member 35, for example of aluminum, and by a vulcanized elastomeric material 36 on said supporting member, is introduced into the tubular member 18 so that either end of the liner abuts the ring 24. In the interior of the supporting member 35 is placed with a loose fit a temporary cylindrical supporting member 37, intended to be slipped out as the roller 38 is being introduced. The tubular member 18 is then closed by applying to its end 25 the bushing 26: the end 25 of member 18 is inserted into the annular groove 29 of the flange 27 of the bushing 26, so that the bushing is nearly entirely introduced into the member 18. Either end of the uncoated roller 38 is inserted into the bushing 26 and the piston 15 is brought to contact the other end of the roller; by feeding pressurized fluid to the cylinder 14 via the duct 17, the piston 15 is caused to emerge for thrusting forcibly, head on, the roller 38 into the tubular supporting member 35 of the liner. As the roller 38 gradually penetrates the supporting member 35, the temporary supporting member 37 emerges from the tubular member 35, by sliding, unhindered, in the self-lubricating bushing 22.

By so doing, a snug fit is obtained, a metal-metal contact indeed, between the roller 38 and the so-called "press-fit" liner, without any necessity of cementing.

On completion of such operation, the piston 15 is drawn into the cylinder 14 again, the bushing 26 is withdrawn from the end 25 of the tubular member 18 and the roller with its liner mounted thereon can be removed from 18 and is ready for use.

If, conversely, it is required that a worn out or defective roller be removed from a roller, the ring 24 is not mounted in the annular groove 23 of the tubular member 18, and the procedure is the following.

The roller 38 with its worn out liner thereon is introduced into the tubular member 18 so that either end of the roller enters the bushing 22. The collar 31 is now applied to the end 25 of the elements 18, care being taken that the blades 33 are inserted in the longitudinal slits 20, 21 of 18. Thereafter, the bushing 26 is applied to the end 25 of the member 18, but the position of the bushing is reverted relative to the one described hereinabove, so that the edge of the member 18 is inserted in the annular groove 30 and the bushing 26 becomes a virtual extension on the member 18. Lastly, the spreader 34 is applied with its open side inserted in the collar 31 and with its closed bottom wall engaging the piston 15.

By causing now the piston 15 to emerge from the cylinder 14, the collar 31 is thrust toward the left by the intermediary of the spreader 34 (as viewed in FIG. 3), so that the blades 33 deeply cut into the liner to be stripped, along two diametrically opposite parallel cutting lines. As soon as the end of the stroke is reached, the liner has been cut along its entire length.

Thereafter, the piston, the spreader and the collar are brought back to their starting positions, the several parts of the apparatus are overhauled and the roller, to which the liner is still attached, is withdrawn. By pulling the liner manually along the two cutting lines (in correspondence with which a tiny layer has been left), the liner can conveniently be stripped without nicking the roller, in the slightest, so that the peripheral surface of the roller remains unaffected throughout.

The advantages afforded by the method and the apparatus according to this invention have been clearly set forth in the disclosure as given hereinabove: they are principally the rapidity and reliability with which the operation of mounting and dismantling pressure roller liners can be carried out dispensing with adhesives which would otherwise originate considerable drawbacks, both from the point of view of the satisfactory liner adhesion and their removal as well.

With the forced metal fit the liners are certainly mounted on the rollers without any possibility of being moved or loosened and the fit is reliable even under the heavy stresses to which the liners are subjected in the up-to-date machines preparatory for spinning.

It is understood that the apparatus as described herein can have various modifications of a constructional nature within the scope of this invention without therefore departing from the ambit of protection thereof.

I claim:

1. An apparatus for mounting and dismantling resilient liners having a metallic supporting member, characterized by comprising a casing in which there are coaxially mounted and spaced apart from each other a tubular member having longitudinal slits terminated at either of its ends, and a piston and cylinder assembly the piston of which is adapted to be shifted in the direction of said end of the tubular member at which said slits are terminated, a first guiding bushing coaxially inserted in the other end of said tubular member, a second guiding bushing having an annular flange in the vicinity of either of its own ends, said second bushing being insertable optionally by either of its ends coaxially into the end of the tubular member which confronts the piston and cylinder assembly, the difference between the inside diameter of the tubular member and the inside diameter of said guiding bushings being slightly greater than the thickness of the liner to be mounted or removed, whereas the inside diameter of the guiding bushings is substantially equal to the outside diameter of the roller on which the liner is to be mounted or from which it is to be removed, a collar carrying internal radial blades, the distance between the cutting edges of said blades being slightly greater that the outside diameter of the roller, such collar being capable of being mounted for sliding on said tubular member with its blades passed through the longitudinal slits thereof and being drivable by said piston through a spreader so as to slide along the tubular member from the end thereof at which said slits are terminated to the opposite end.

2. An apparatus according to claim 1, characterized in that said first guiding bushing is made of a synthetic self-lubricating material.

3. An apparatus according to claim 1, characterized in that the collar carries two confrontingly mounted blades.

* * * * *